US008167218B2

(12) United States Patent
Andre

(10) Patent No.: US 8,167,218 B2
(45) Date of Patent: May 1, 2012

(54) RAIL GUIDING OR ROLLING BEARING AND LAYING METHOD

(75) Inventor: Jean-Luc Andre, Molsheim (FR)

(73) Assignee: Lohr Industrie, Hangenbieten (FR)

( * ) Notice: Subject to any disclaimer, the term of this patent is extended or adjusted under 35 U.S.C. 154(b) by 0 days.

(21) Appl. No.: 12/522,050

(22) PCT Filed: Dec. 21, 2007

(86) PCT No.: PCT/FR2007/002161

§ 371 (c)(1),
(2), (4) Date: May 4, 2010

(87) PCT Pub. No.: WO2008/096079

PCT Pub. Date: Aug. 14, 2008

(65) Prior Publication Data

US 2010/0213268 A1 Aug. 26, 2010

(30) Foreign Application Priority Data

Jan. 5, 2007 (FR) ..... 07 00050

(51) Int. Cl.
*E01B 21/00* (2006.01)

(52) U.S. Cl. ..... 238/2; 238/3

(58) Field of Classification Search ..... 238/2–8
See application file for complete search history.

(56) References Cited

U.S. PATENT DOCUMENTS

| | | | | |
|---|---|---|---|---|
| 5,181,657 | A * | 1/1993 | Davis | 238/8 |
| 5,464,152 | A * | 11/1995 | Wabnitz | 238/8 |
| 5,538,182 | A * | 7/1996 | Davis et al. | 238/8 |
| 5,622,312 | A * | 4/1997 | Martin | 238/2 |
| 5,788,153 | A * | 8/1998 | Ortwein | 238/7 |
| 6,270,017 | B1 * | 8/2001 | Vennell | 238/1 |
| 6,364,215 | B1 * | 4/2002 | Andre et al. | 238/122 |
| 6,471,138 | B1 * | 10/2002 | Blank et al. | 238/122 |
| 6,616,061 | B1 * | 9/2003 | Penny | 238/7 |
| 7,228,803 | B2 | 6/2007 | Andre et al. | |
| 7,484,669 | B2 * | 2/2009 | Gray, Jr. | 238/3 |
| 2003/0168519 | A1 * | 9/2003 | Hofstetter, Sr. | 238/8 |
| 2007/0034705 | A1 * | 2/2007 | Gray | 238/8 |
| 2010/0213268 | A1 * | 8/2010 | Andre | 238/122 |

FOREIGN PATENT DOCUMENTS

| | | | |
|---|---|---|---|
| FR | 2 270 083 | | 12/1975 |
| FR | 2 862 072 | A1 | 5/2005 |
| FR | 2862072 | A1 * | 5/2005 |
| FR | 2 865 986 | A1 | 8/2005 |

* cited by examiner

*Primary Examiner* — S. Joseph Morano
*Assistant Examiner* — Jason C Smith
(74) *Attorney, Agent, or Firm* — Davis & Bujold, P.L.L.C.

(57) ABSTRACT

A support including a rail (10) that preferably has an I-shaped section and is provided in a slot (2) filled with concrete (4). During the manufacture of the rail, the rail is partially coated, substantially along its entire length, with a filler material (8) which defines at least one side extension (16) and bears on the concrete. A side groove (9) is formed in the coating of filler material (8) for the passage of a guiding or rolling wheel. The rail is directly maintained by the concrete such that an intermediate device, for additional maintenance of the rail, is not required. The rail can be bent and curved at the time of installation to conform to the curves of the track without any independent or additional bending step.

23 Claims, 5 Drawing Sheets

RAIL GUIDING OR ROLLING BEARING AND LAYING METHOD

This application is a National Stage completion of PCT/FR2007/002161 filed Dec. 21, 2007, which claims priority from French patent application serial no. 07 00050 filed Jan. 5, 2007.

FIELD OF THE INVENTION

The invention relates to a rolling or guiding rail support coated with a filler material, and to a method for positioning it in the ground.

The rail according to the invention is preferably produced and supplied in straight sections, which are bent when being installed so as to fit the curves of the track.

In a particular application, the invention concerns a support comprising a coated guiding rail, designed to be embedded in the ground, with edges that form rolling tracks for a guiding assembly with inclined flanged wheels for an urban public transport road vehicle.

BACKGROUND OF THE INVENTION

Certain urban public transport vehicles are guided by a guide rail whose upper surface is flush with, or stands slightly above ground level.

Classically, this guide rail is positioned in a channel hollowed out of the ground and filled with concrete, in which it rests on its support base and in which it is held by intermediate fixing means distributed regularly along the channel.

The space between the concrete and the sides of the guide rail can then be filled in with a filler material which leaves free linear spaces known as grooves as needed to allow the passage of the flange of the guide wheel(s).

According to a previous invention by the present applicant, this filler material is preferably a synthetic resin cast in place on the spot at the time when the guide rail is being positioned. It has compressibility properties which enable it to ensure the clearing, pressing down or incrustation of objects that can make their way into the guide groove.

Indeed, by virtue of its exposure to the elements and the surroundings, it often happens that the groove is obstructed by all kinds of objects, in particular for example debris, plants, ice, snow, pebbles or other foreign bodies or objects deposited by accident or deliberately, and which can constitute an obstacle to the passage of guide wheels with flanges and may lead to damage of the wheels, or which create a risk that the guiding assembly of the vehicle, or more seriously the vehicle itself, is derailed.

By virtue of its adapted compressibility properties this filler material enables the ejection, pressing down, or incrustation of objects during the passage of the guide wheel(s), thereby allowing the guide wheels to pass over in safety.

Since the guide groove has to remain clear, and owing to the presence of the support base, the layer of filler material is not very thick at that level. Although it may be sufficient to allow objects of small size to be pressed down, larger objects can continue to protrude and interfere with the guiding of the vehicle.

Moreover, whereas this filling with a filler material plays an important part for the function of guiding correctly, producing it is not an easy operation and often poses problems.

In fact, according to the prior art the resin is made and cast at the worksite. Thus, its composition is not totally controlled and can vary due to component metering errors but also due to weather and climate conditions.

Applying it by casting all along the rail while preserving a precise geometry is already, in itself, a difficult operation which is made even more problematic because it takes place in the open and therefore with variable parameters such as different weather conditions at the time, for example rain, cold or great heat, and other conditions such as sloping ground, which can complicate the casting of the filler material.

Such a situation can result in harmful defects or even ones that are dangerous for the use of the vehicle.

SUMMARY OF THE INVENTION

The purpose of the present invention is to provide a guiding or rolling support whose guide or rolling rail is already covered with the filler material before it is positioned in the ground.

The rolling or guide support according to the invention comprises a guide or rolling rail and a channel filled with a sealing material in which the rail is positioned. The rail has a head whose shape is appropriate for the rolling of at least one guiding or rolling wheel, a base, and a web joining the head and the base.

According to the invention, before being positioned the guide or rolling rail is partially coated essentially along its entire length with a filler material which forms a coating that comprises at least one lateral extension designed to rest on the sealing material, and in which a lateral groove is formed as needed to allow passage of the guide or rolling wheel.

According to another essential characteristic of the invention, the guide or rolling rail is directly blocked and held in place by the sealing material without recourse to any intermediate means to provide additional fixing.

The used filler material preferably has compressibility properties which enable it to ensure that any objects present in the lateral groove are cleared, pressed down or incrusted during the passage of the guide or rolling wheel.

According to a preferred embodiment of the rolling or guiding support according to the invention, the guide or rolling rail is directly bent when being positioned at its installation site, without any independent, supplementary bending stage.

The rail according to the invention comes from the factory coated with the filler material. It is made under stable and optimum conditions. The composition and geometry of the filler material can therefore be controlled perfectly in a reproducible manner, thus ensuring that the coated rail has good dimensional regularity.

The coating is preferably stuck, bonded or vulcanized around the rail, and this also protects the rail against corrosion. Thus, the rail can be descaled by shot blasting or some other method, then coated with paint or an adhesion-promoting layer if necessary, and then coated with filler material. Other methods of uniting the rail and its coating are also possible.

The straight rail sections, coated by their filler material coating mass, are then delivered and easily positioned on site.

The rail, according to the invention, preferably has a cross-section of slender shape, for example an essentially I-shaped cross-section without substantial lateral inertia, which enables it to bend automatically when being positioned at its implantation site.

Accordingly, the stage of independent, supplementary bending during the manufacture of, or shortly before positioning classical rails with bases, is avoided. Such an independent bending operation, which is generally carried out by means of rollers, could in any case damage the coating.

The rail according to the invention is advantageously supplied without a base, or without a substantial base or support at the bottom and of height greater than the rails of the prior art. The thickness of the filler material along the lateral flanks of the rail is thus much greater than in the prior art. However, the total quantity of filler material is virtually the same, so that this solution does not involve substantial additional cost.

Thanks to its advantageous shape with no support or simply a wider base, and thanks to the greater thickness of its filler material, the rail according to the invention also improves the sinking down of objects even of fairly large size.

Besides, the rail according to the invention can be positioned on site in several ways, two examples of which will be described in detail below, so that the requirements pertaining to public works and those related to the safety of urban public transport vehicles guided by a guide rail are satisfied at the same time.

In all cases the guide or rolling rail is positioned directly in the sealing material and held fast in or by the latter, without any intermediate holding means.

This eliminates the need for fixing means of various kinds as used in the prior art for fixing the rail at the bottom of the channel at regular intervals.

Accordingly, the rail can be positioned more rapidly and economically. This also makes it possible for the coating to be continuous essentially over the whole length of the rail or rail section. It can therefore fulfill its function essentially over the full length of the rail without interruptions associated with the presence of fixing means.

BRIEF DESCRIPTION OF THE DRAWINGS

Other characteristics and advantages of the invention will emerge on reading the detailed description given below, with reference to the attached drawings which show.

DETAILED DESCRIPTION OF THE DRAWINGS

Figure 1:
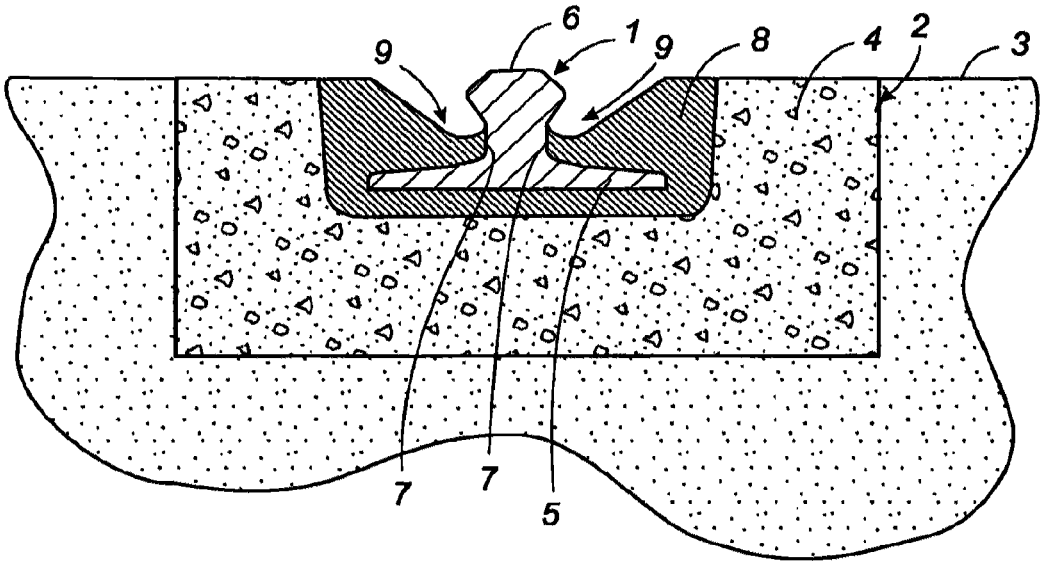
FIG. 1: Cross-sectional view of a guide rail of the prior art, in place in the ground.

Referring to the attached FIG. 1, an example of a guiding support according to the prior art will be described below.

A guide rail 1 is positioned in a channel 2 hollowed out of the ground 3 and lined with a sealing material 4, classically concrete.

At the bottom, the guide rail 1 has a support base 5 which rests in the channel 2 on a layer of concrete, in such manner that the top surface 6 of the rail 1 is flush with, or protrudes slightly above the level of the ground 3 so as to guide urban public transport vehicles.

According to an original feature protected previously, after the rail has been positioned in the channel the space between the sealing material 4 and the flanks 7 of the guide rail is advantageously filled with a filler material 8, but leaving free the grooves 9 needed for the passage of the guide wheel(s) of the vehicles.

Several preferred embodiments of the guiding or rolling support according to the invention, comprising a guide or rolling rail 10 and a channel 2 filled with a sealing material 4, will now be described in detail with reference to FIGS. 2 to 16. Equivalent elements represented in the different figures are given the same indexes.

In the remainder of this description the concepts of top and bottom, lower and upper, head and base, etc., will be defined as a function of the orientation adopted by the rail shown in the various figures. Clearly, this orientation need not necessarily be preserved during use, particularly when the guide rail concerned is a lateral guide rail.

The term 'channel' is here understood to mean any hollow, groove or channel formed in the ground or in any other support and designed to receive one or more rail(s) immobilized in a sealing material, preferably concrete.

It may also be used for a trough partially or wholly embedded in or placed on the ground or another support, or more generally, any linear track structure that forms a foundation for the positioning and immobilization of one or more rails.

In the same way, although the channel is preferably positioned at ground level, it can also be positioned elsewhere and in particular on a sidewall bordering the circulation track of an urban public transport vehicle guided laterally.

In the preferred embodiments illustrated, the rail 10 according to the invention has a cross-section of substantially I-shaped form whose ends, i.e. a mushroom or head 11, and a base 12, are joined by an elongated and narrow web 13 forming the axis of the I.

The head 11 and the base 12 of the rail 10 according to the invention are preferably essentially symmetrical relative to the median transverse plane of the rail.

The head 11 of the rail 10 can have any external shape suitable for the function it has to fulfill depending on the application of the rail 10. Thus for example, it can have one or more edge(s) 14 suitable for serving as a rolling track for the guide or rolling wheel(s) 15 of the vehicle.

The rail 10 illustrated is preferably higher than the rail 1 of the prior art, and has no support base 5 at the bottom. Thus, it has a certain flexibility which enables it to adapt to the curves of the track.

Accordingly, it can advantageously be produced and delivered only in straight sections, which can be bent before or when they are positioned, as necessary, to conform to the track specified and which can, for example, automatically bend itself by sinking into a groove of curved contour.

The shape of the rail 10 is preferably symmetrical with respect to its longitudinal median plane, so as to avoid any distortion or twisting of the rail while it is being fitted around curves.

However, the shape of the rail 10 according to the invention can be different from that shown, provided it is appropriate for the guiding or rolling function that the rail is required to fulfill and that it preferably enables bending on site while the guide rail is being positioned, or self-bending by deformation of the rail during its positioning.

Thus for example, it would be possible to imagine a rail with no base 12 and with a thin, flat web 13, or even a flat rail with an essentially rectangular cross-section, i.e. a cross-section of substantially constant width over its entire height, for example with the shape of a blade.

Preferably, the rail 10 according to the invention has little lateral inertia, so that it can be bent on site while being positioned without an independent, supplementary bending stage.

Figure 2:
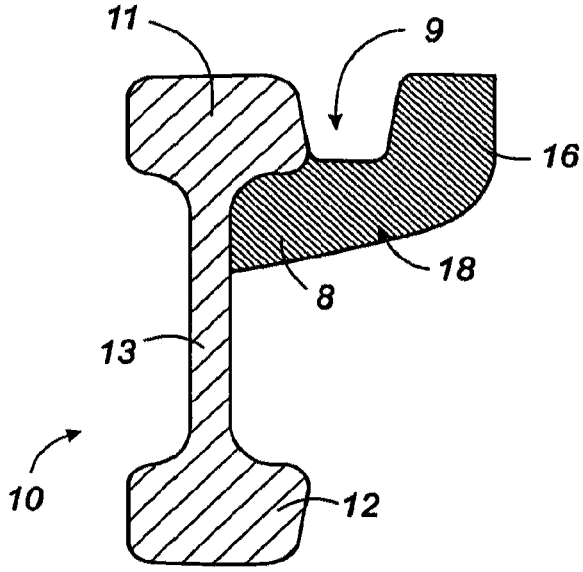
FIG. 2: Cross-sectional view of a basic variant of a coated guide rail according to the invention, shown in isolation.

A basic variant of the invention is shown in FIG. 2.

In this variant, the rail has a lateral extension 16 made of the filler material 8, preferably rising and designed to rest on the sealing material 4, in which a lateral groove 9 is formed as needed for the passage of a guide or rolling wheel 15 and more particularly its flange 17.

Note that in this version, for example, the guide wheel can also be a load-bearing roller or wheel as found classically in railway vehicles.

In a preferred embodiment of the invention illustrated in FIGS. 3 to 16, the said lateral extension 16 of filler material 8 is part of a more complete coating 18 of filler material 8.

Preferably, the rail 10 can thus be coated with a mass of filler material 8 at the level of its median and lower areas, namely, in the preferred variants shown, at the level of its web 13 and its base 12.

The upper part of the rail 10, corresponding essentially to its head 11, is left free with no coating so as not to interfere with its functional areas. Access to the edges 14 is therefore possible and one or more lateral grooves 9 can be configured so as not to impede the dynamic engagement of the wheels 15.

Preferably, the shape of the coating 18 substantially follows the contours of the rail 10. Thus, in the examples illustrated the coating 18 has an inferior bulge 19 extended by a central portion 20 which is preferably thin and elongated.

The central portion 20 of the coating 18 opens out at the top to form at least one lateral extension 16, which preferably rises and is designed to rest on the sealing material 4.

Depending on the model of the rail 10 and its application, a lateral extension 16 can be provided on each side of the rail 10 so as to form two lateral grooves 9.

As can be seen in FIGS. 3 to 16, the amount of filler material 8 bordering the flanks 21 of the rail 10 shown is much greater than in the prior art. Objects of considerably larger size can advantageously sink into it and/or become embedded in it so as not to impede the movement of the guiding or rolling wheels 15 of the vehicle.

The filler material 8 is any suitable synthetic material with sufficient elasticity to fulfill the function described earlier and able to resist exterior climatic conditions and the conditions of use to which it will be subjected in this application.

It is chosen such that it never interferes with the engagement of the wheels 15 whatever the environmental conditions, in particular the climatic conditions and the conditions of use of the vehicle within the limits specified by the manufacturer. In particular, it only expands or dilates very little, even under the effect of temperature variations and precipitation.

Advantageously, the material may be designed to insulate the rail 10 electrically from the ground. In that case the rail 10 is preferably coated over the whole of its parts in contact with the ground. For a buried rail, for example, such as that represented in FIGS. 6 and 7, the insulating coating covers the lower and median parts of the rail completely.

However, and as already indicated earlier, so extensive a coating 18 is not essential to the invention and can in particular cover only one side of the rail 10, or only its median area leaving free its supporting base 12, or even for example only a very small area of the rail limited to the zone around the lateral groove 9, as in the basic variant shown in FIG. 2.

An essential feature of the invention is that the rail 10 is coated with its layer of filler material 8 before being positioned where it is to be used.

This coating of filler material 8 is advantageously continuous over substantially the full length of the rail or rail section. Since the guide rail is positioned directly in the channel 2 and held therein by the sealing material 4, it is in effect not necessary to allow for interruptions of the coating to permit the insertion of intermediate fixing means.

The functions of clearing, pressing in or embedding foreign bodies present in the lateral groove 9, which is ensured by the filler material 8, can thus be advantageously fulfilled over the full length of the guide rail 10.

The coating 18 is preferably applied on or formed around the rail during or after its manufacture, for example by extrusion of the filler material 8 around the rail 10. Thus, the coating 18 of filler material 8 can advantageously be produced at the factory under stable and optimum conditions, which ensure a controlled and reproducible composition and geometry.

The sections of rail 10 covered with their coating layer 18 are then delivered and placed in position on site.

As in the prior art, the coated rail 10 according to the invention is positioned in a channel 2, for example hollowed out of the ground 3 and filled with a sealing material 4, preferably concrete.

However, no intermediate means are used to ensure the fixing of the rail 10 in the channel 2. The rail is held in place directly by the sealing material 4.

Figure 6:
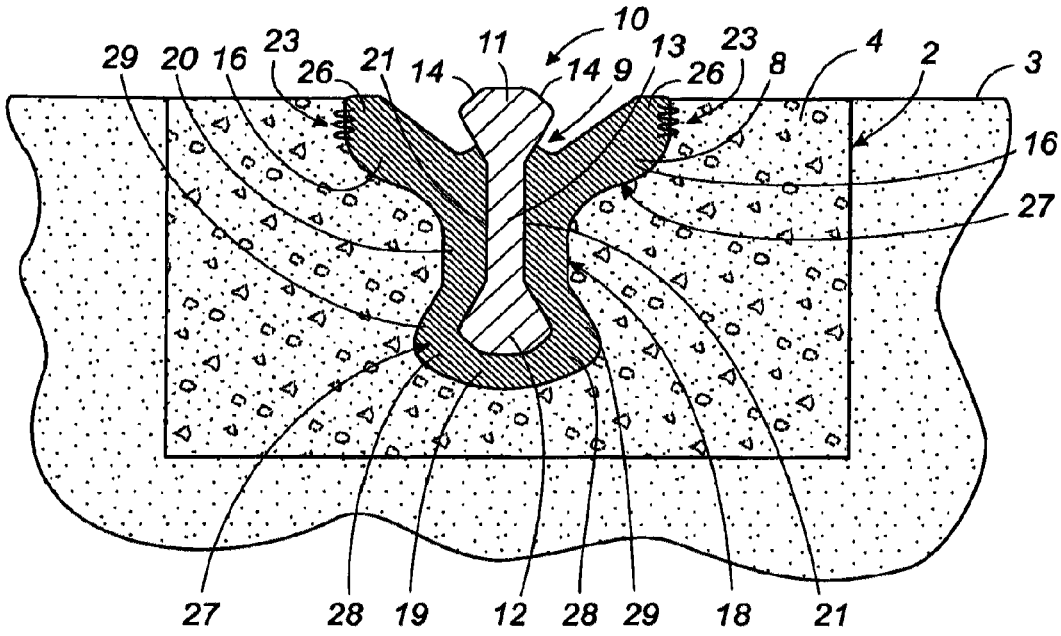
FIG. 6: Cross-sectional view of the coated guide rail shown in FIG. 3, positioned in the ground.
Figure 7:
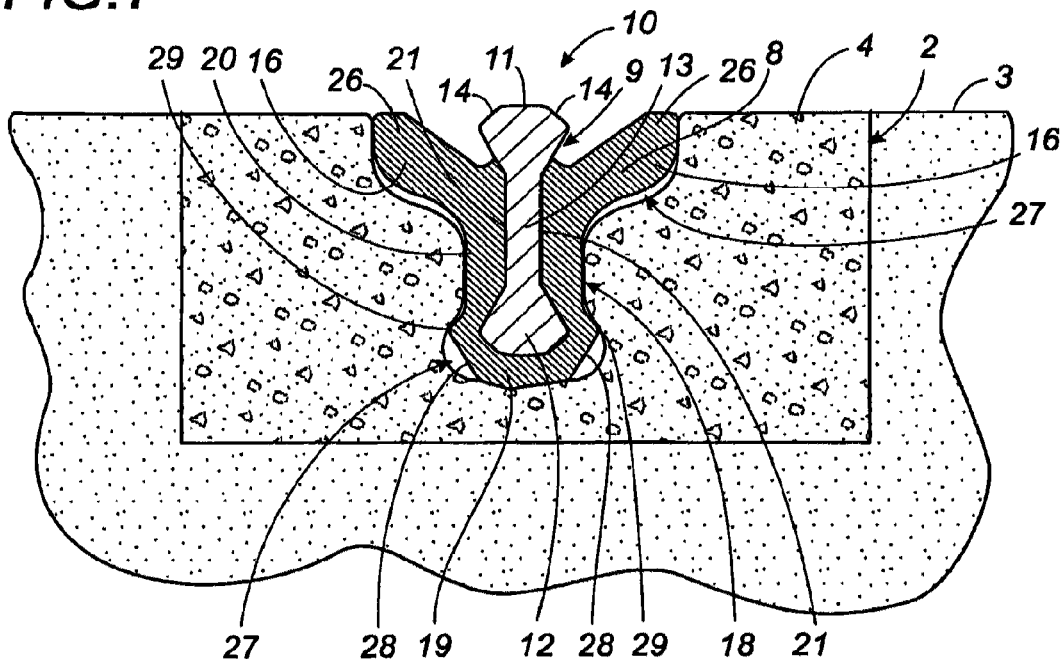
FIG. 7: Cross-sectional view of the coated guide rail shown in FIG. 4, positioned in the ground.

Two examples of coated rails 10 according to the invention are shown in their service position in the ground in FIGS. 6 and 7.

To position the rail 10 according to the invention, the present inventors used two preferred methods which are diagramatically illustrated respectively in FIGS. 11 to 13 and 14 to 16.

Figure 11:
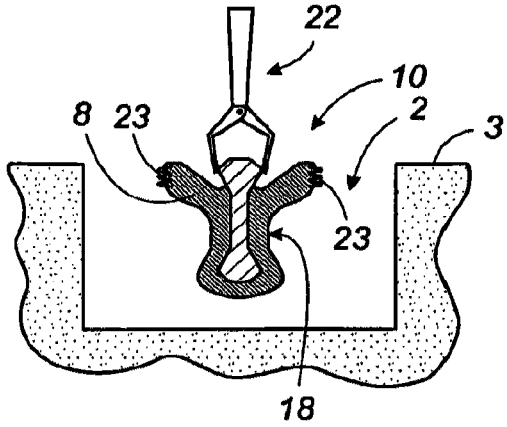
FIGS. 11 to 13: Schematic cross-sectional views illustrating the various stages of a first method for positioning a guiding support according to the invention.
Figure 12:
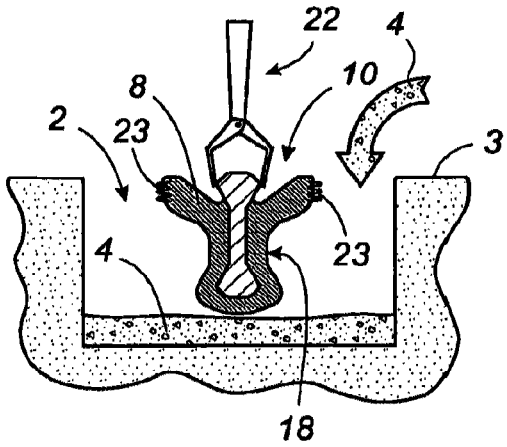
Figure 13:
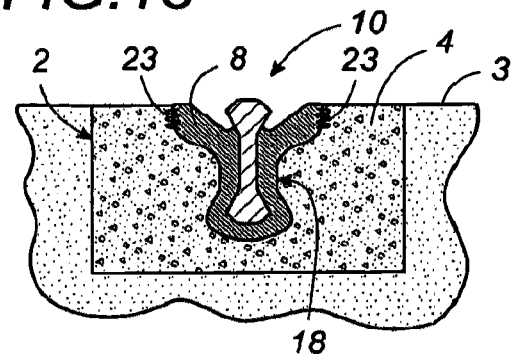

In a first positioning method whose stages are shown in FIGS. 11 to 13, the coated rail 10 can be placed in the channel 2 before beginning to fill it with sealing material 4, or when it is only partly filled (FIG. 11).

The coated rail 10 must then be positioned exactly at the level of its final location, and be held there by any suitable temporary holding device 22. In the figures, this temporary holding device 22 has been schematically represented as a gripper. Nevertheless, its shape and nature can be quite different.

Into the channel 2 is then cast concrete or any other desired sealing material 4, using techniques that are known and fully mastered whatever the weather conditions at the time (FIG. 12). The sealing material 4 spreads around the rail 10 and its coating 18, filling the channel up to the final level desired.

After drying and setting, the sealing material 4 ensures that the rail 10 is held via its coating 18 of filler and holding material 8. The temporary holding device 22, which is no longer needed, can now be removed.

Figure 3:
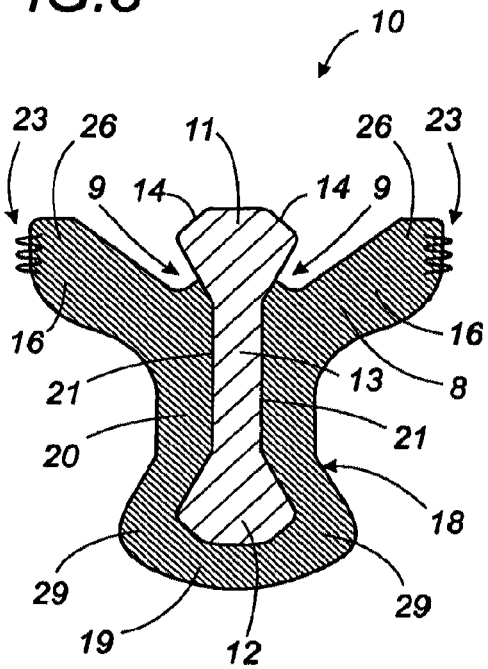
FIG. 3: Cross-sectional view of a second variant of a coated guide rail according to the invention, shown in isolation.
Figure 4:
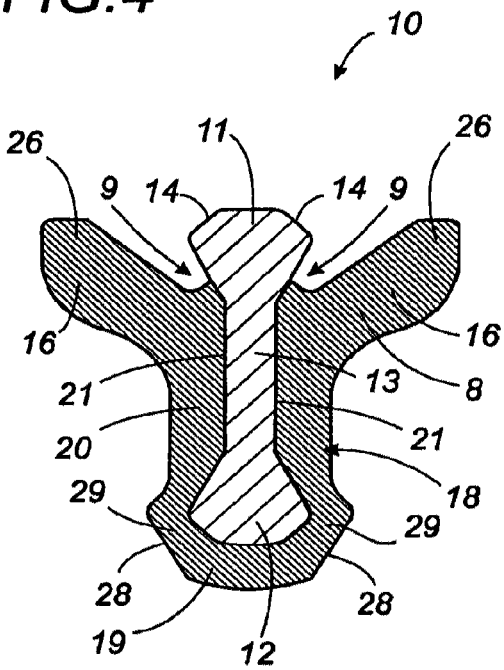
FIG. 4: Cross-sectional view of a third variant of a coated guide rail according to the invention, shown in isolation.
Figure 5:
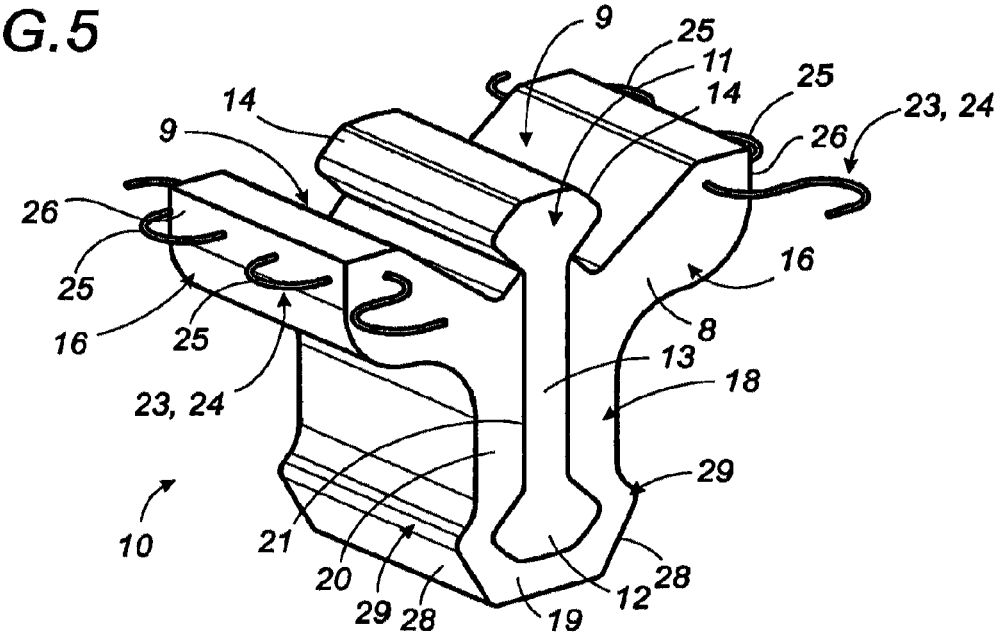
FIG. 5: Perspective view of a section of a coated guide rail, according to a fourth variant of the invention.

In this case and in accordance with the variants of the invention shown in FIGS. 3 and 5, means 23 for promoting adhesion or attachment, in particular in the form of a surface treatment or of relief elements or recesses, for example projecting fibers preferably of metal or a synthetic material, can advantageously be provided on the outside surface of the coating 18 in order to improve the bond between the sealing material 4 and the filler material 8 at the interface between those two materials.

An example of an adhesion-promoting means 23 has been shown in the perspective view in FIG. 5. In this case it consists of a wire shaped in a series of successive undulations and embedded at the periphery of the coating 18 in such manner that a succession of loops 25 project from the latter to facilitate the attachment to the sealing material 4.

This adhesion means 23 is preferably located mainly at the level of the free end 26 of the lateral extension(s) 16 located in the interface zone where the displacing force is greatest during use, in particular because of the transverse rolling of the vehicles running along the guiding track.

However, the adhesion means 23 can be located anywhere on the outer surface of the coating 18, locally or over all of the outer surface.

The adhesion-promoting means 23 can also be implemented by a suitable surface treatment, or by using a cellular or agglomerated material as the filler material 8.

Figure 14:
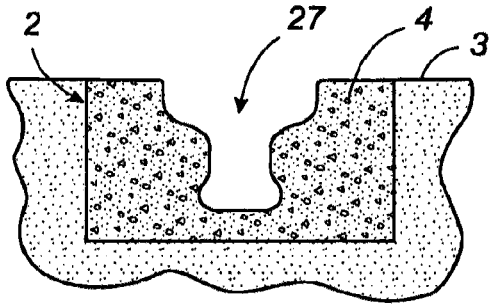
FIGS. 14 to 16: Schematic cross-sectional views illustrating the various stages of a second method for positioning a guiding support according to the invention.
Figure 15:
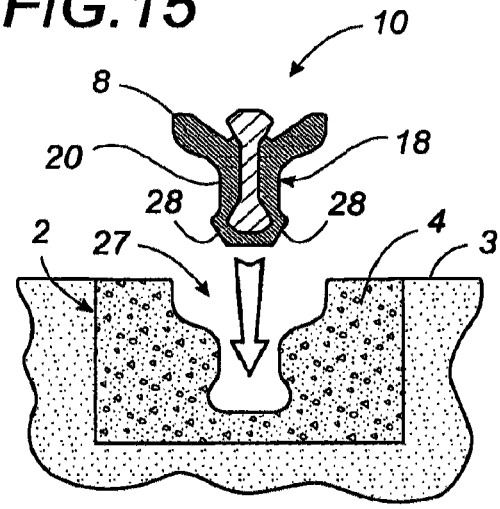
Figure 16:
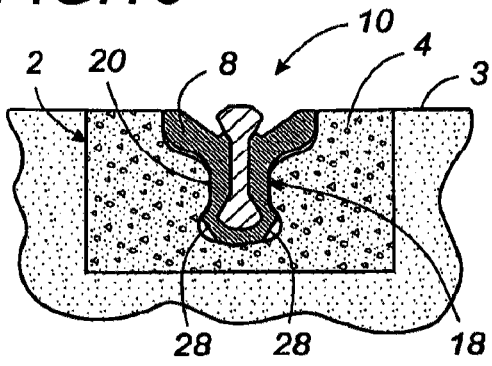

In the second positioning method illustrated in FIGS. 14 to 16, the channel 2 is filled with the sealing material 4 before the coated rail 10 is put in place, making a passage 27 in the sealing material 4, for example by sliding shuttering during the filling of the channel, preferably widening out toward the bottom and of a shape substantially complementary to the outer shape of the rail 10 with its coating 18 (FIG. 14).

In another variant (not shown), the passage 27 can also be made after the channel 2 has been filled, by grooving the sealing material 4 present in the channel 2.

When the sealing material has dried and set, the coated rail 10 according to the invention is force-fitted into the passage 27 until it is properly embedded, for example with the aid of a compressing roller (FIG. 15).

Around curves this embedding is accompanied by progressive bending of the rail. This is true self-bending, during which the final curvature needed is obtained at the end of the embedding process. Thanks to the properties of the rail, the bending takes place without tilting, i.e. without inclination of the upper part of the rail.

The force-fitting of the rail 10, made possible by the compressible nature of the filler material 8, can be facilitated by adapting the external shape of the coating 18, in particular the bulge 19 at the bottom thereof.

Thus for example, the bottom bulge 19 can have beveled edges 28 so as to form inclined fitting ramps that converge downward to guide the engagement of the rail 10.

The local constriction or tightness of the central portion 20 of the coating 18 ensures that the embedding is self-maintaining.

Accidental or ill-intentioned extraction of the rail 10 out of the passage 27 is prevented by the lateral extension force of the filler material 8, which during the force-fitting, is prestressed in compression especially at the level of the constriction of the central portion 20, by virtue of the geometry and respective dimensions of the coating 18 and the passage 27. The projecting edges 29 of the bottom bulge 19 also oppose any such extraction.

Thus, the rail 10 offers resistance against being pulled out and whereas the wheels fit tightly round the rail, the guiding system is firmly anchored to the ground.

In the event of problems, the rail 10 according to the invention can easily be removed. For this it is only necessary to cut down into the filler material 8 from above on either side of the rail 10, enabling it to be extracted from its fitted position.

In the case when the coated rail 10 has been embedded in a passage 27 of complementary shape (FIGS. 14 to 16), the remaining bits of filler material 8 can in their turn be very easily removed once the rail section has been extracted, since there is then no longer any lateral compression.

The rail section removed can then be replaced by a new section of coated rail 10 according to the invention, using the same positioning method as before.

In the case when the coated rail 10 has been anchored by casting the sealing material around it (FIGS. 11 to 13), the remaining bits of filler material 8 continue adhering to the sealing material after the rail section 10 has been extracted.

The rail section then has to be replaced locally by a section of uncoated rail, the joining and filling between this section and the remaining parts of filler material 8 still anchored in the sealing material then being carried out classically by casting in a resin.

This method can also be used at the level of welds in the rail, where the rail is partially stripped to allow welding or other mechanical fixing means as necessary.

It is also conceivable that no fixing is needed between adjacent sections, since the rail is sufficiently firmly held to allow alignment and thus correct guidance of the vehicle.

Clearly, the invention is not limited to the preferred embodiments and positioning methods illustrated and described above, and those skilled in the art will be able to make numerous modifications and to imagine other variants without going beyond the scope of the inventive concept.

For example, although the sealing material 4 is preferably concrete, any other material that ensures immobilization of the coated rail 10 in a channel 2 could be used in place of the concrete.

Moreover, the invention can be adapted by those skilled in the art to any type of guide or rolling rail 10 for public transport vehicles, without being limited to any particular guiding or rolling system.

Figure 10:
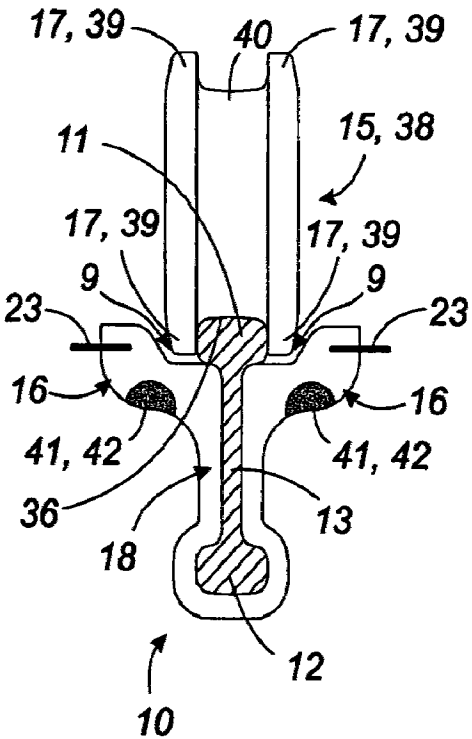
FIG. 10: Cross-sectional view of a seventh variant of a coated guide rail according to the invention, engaged with a straight guide wheel with two flanges.
Figure 9:
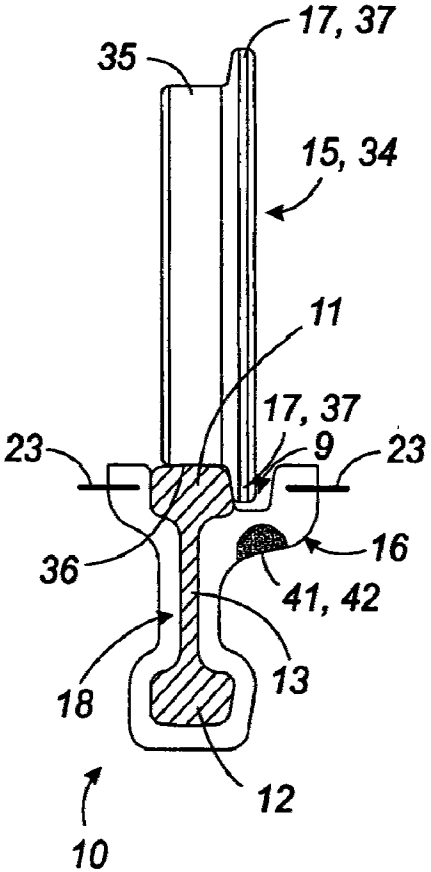
FIG. 9: Cross-sectional view of a sixth variant of a coated guide rail according to the invention, engaged with a straight guide wheel with one flange.
Figure 8:
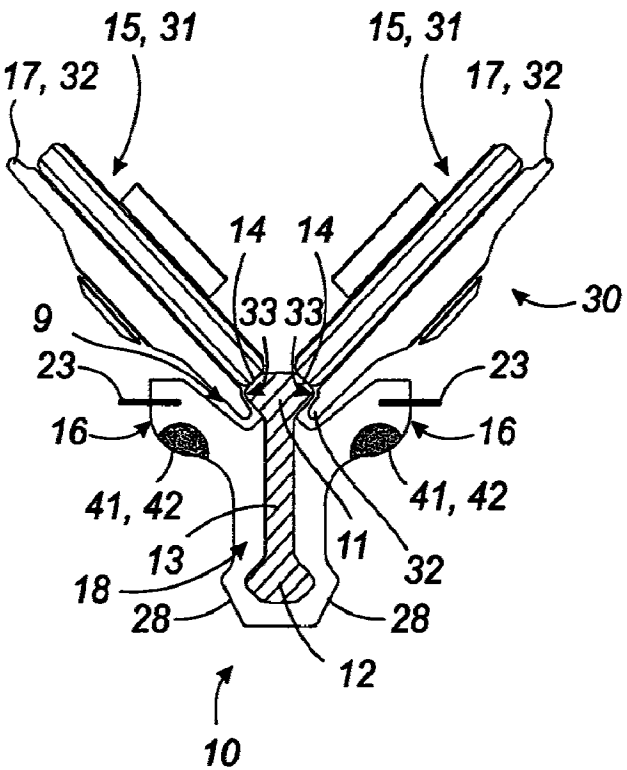
FIG. 8: Cross-sectional view of a fifth variant of a coated guide rail according to the invention, engaged with a pair of flanged guide wheels inclined in a V shape.

FIGS. 8 to 10 illustrate, in a non-exclusive or limiting manner, the application of the invention in three different guiding systems.

In FIG. 8 a variant of the coated rail 10 according to the invention is engaged with a guiding system 30 comprising two wheels 31 inclined in a V-shape, which roll on rolling tracks 14 inclined at the level of the upper part of the head 11 of the guide rail 10.

The flanges 32 of each of the inclined guide wheels 31 extend on either side of the head 11 of the rail as far as under the projecting flanks 33 thereof. They move within the lateral grooves 9 made in the compressible material of the lateral extensions 16 of the coating 18, under the head 11 of the rail and on either side thereof.

The embodiment shown in FIG. 9 is adapted for a guiding wheel 34 designed to co-operate with a grooved rail. The tread of the wheel 34 rolls on the flat upper surface 36 of the guiding rail 10, which serves as its rolling track.

This type of wheel 34 is provided on only one of its sides with a flange 37 forming a peripheral edge. This flange 37 moves along a single lateral guiding groove 9 formed by means of the coating 18 according to the invention, which laterally borders one of the sides of the head 11 of the rail with a lateral extension 16 that reproduces the geometry of a conventional grooved rail.

The guide wheel 38 in FIG. 10 has two flanges 39, forming a peripheral edge on each side of its tread 40.

The guiding rail 10 variant shown in FIG. 10 is designed to co-operate with this type of wheel. It is similar to that of FIG. 9, but comprises a lateral coating extension 16 on each side of the head 11 of the rail, so as to form a groove 9 laterally bordering the rail head 11 on each side thereof so as to enable the movement of the two flanges 39.

The guiding or rolling rail 10 according to the invention can clearly be modified in other ways without going beyond the general concept of the invention. For example, the coating 18 can include one or more insert(s) of different material, such as 41 in FIGS. 8 to 10. These inserts can be flush with or embedded in the filler material 8 forming the coating 18. They may also project outside it.

For example, one or more longitudinal strip(s) 42 can be co-extruded with the coating 18 at the level of the lateral extension 16, preferably made of a material more compressible than the filler material 8, for example an appropriate foam or cellular material. By creating zones of greater compressibility such inserts facilitate the embedded positioning of the rail according to the invention.

The invention claimed is:

1. A guiding support comprising:

a guiding rail (10) and a slot (2) filled with a sealing material (4) in which the guiding rail (10) is positioned, the guiding rail (10) comprising:

a head (11) of a shape suitable for the rolling of at least one guiding wheel (15), a base (12) being shaped similar to a shape of the head (11), the guiding rail (10) being symmetrical relative to a medial longitudinal plane, and a web (13) joining the head (11) to the base (12), the guiding rail (10), before being positioned, being partially coated with a filler material (8), substantially over its full length, to form a coating (18) comprising at least one lateral extension (16) that contacts the sealing material (4) and has a formed lateral groove (9) which facilitates passage of the guiding wheel (15);

the guiding rail (10), coated with the filler material (8), being directly held in place by the sealing material (4);

the guiding rail (10) having a slender cross-section and a combined width of the head (11) and the filler material (8), including the at least one lateral extension, extending normal to the medial longitudinal plane being greater than a combined width of the base (12) and the filler material (8), extending normal to the medial longitudinal plane, such that the guiding rail (10) and the filler material (8) together form a Y-shaped configuration; and the guiding rail (10) facilitating bending of the guiding rail, about the medial longitudinal plane, during installation, while being positioned on site, without any additional bending stage.

2. The guiding or rolling support according to claim 1, wherein the lateral groove (9) is defined solely by the head (11) of the guiding rail (10) and the coating (18).

3. The guiding support according to claim 1, wherein the guiding rail (10) has a generally I-shaped cross-section.

4. The guiding support according to claim 1, wherein the guiding rail (10) has a substantially rectangular cross-section with a substantially constant width over an entire height thereof.

5. The guiding support according to claim 1, wherein the head (11) and the base (12) of the guiding rail (10) are symmetrical relative to a medial transverse plane of the guiding rail (10).

6. The guiding support according to claim 1, wherein the guiding rail (10) is symmetrical relative to a medial longitudinal plane.

7. The guiding support according to claim 1, wherein the guiding rail (10) is formed as a straight section of rail.

8. The guiding support according to claim 1, wherein the coating (18) is one of stuck, bonded and vulcanized to the guiding rail (10).

9. The guiding support according to claim 1, wherein the coating (18) comprises two lateral extensions (16) which each extend on sides of the guiding rail (10).

10. The guiding support according to claim 1, wherein the coating (18) substantially follows contours of the guiding rail (10) and has a bulge (19) at a bottom and a central portion (20) that extends upward such that the coating (18) respectively covers the base (12) and the web (13) of the guiding rail (10).

11. The guiding support according to claim 10, wherein the bulge (19), at the bottom of the guiding rail (10), has bevels (28) that form inclined fitting ramps.

12. The guiding support according to claim 1, wherein the coating (18) has an outer surface with an adhesion-promoting device (23) which facilitates adhesion or attachment of the guiding support to improve a securing joint at an interface between the sealing material (4) and the filler material (8).

13. The guiding support according to claim 12, wherein the adhesion-promoting device (23) comprises projecting fibers of either a metallic material or a synthetic material.

14. The guiding support according to claim 13, wherein the adhesion-promoting device (23) comprises a wire (24) configured in a series of successive undulations.

15. The guiding support according to claim 12, wherein the adhesion-promoting device (23) is located at a level of a free end (26) of a lateral extension (16) of the coating (18).

16. The guiding support according to claim 1, wherein the coating (18) of the filler material (8) includes at least one insert (41) of a different material.

17. The guiding support according to claim 16, wherein the insert (41) is a longitudinal strip (42) of a material which is more compressible than the filler material (8) and which is co-extruded with the coating (18) at a level of a lateral extension (16).

18. The guiding support according to claim 1, wherein the guiding wheels (15) are guiding wheels (31) that are inclined in a V-shape and communicate with a guiding system (30) of an urban road vehicle for public transport.

19. A method of positioning a guiding or rolling support either on or in ground, the guiding or rolling support comprising a guiding or rolling rail (10) and a slot (2) filled with a sealing material (4) in which the guiding or rolling rail (10) is positioned, the guiding or rolling rail (10) comprising a head (11) of a shape suitable for the rolling of at least one guiding or rolling wheel (15), a base (12) having a shape similar to a shape of the head (11), and a web (13) joining the head (11) to the base (12), the guiding or rolling rail (10), before being positioned, is partially coated with a filler material (8) to form a coating (18), substantially over its full length, comprising at least one lateral extension (16) that contacts the sealing material (4) and forms a lateral groove (9) to facilitate the passage of the guiding or rolling wheel (15); and the guiding or rolling rail (10), coated with the filler material (8), being directly held in place by the sealing material (4), the guiding or rolling rail (10) having a slender cross-section and a combined width of the head (11) and the filler material (8), including the at least one lateral extension, extending normal to the medial longitudinal plane being greater than a combined width of the base (12) and the filler material (8), extending normal to the medial longitudinal plane, such that the guiding rail (10) and the filler material (8) together form a Y-shaped configuration, the method comprising the steps of:

making a channel (2);

positioning the coated guiding or rolling rail (10) at a level of its final location in the channel (2) and retaining the guiding or rolling rail (10) in position by a suitable temporary holding device (22);

casting a sealing material (4) into the channel (2) up to a desired level;

allowing the sealing material (4) to dry and set; and removing the temporary holding device (22).

20. A method of positioning a guiding or rolling support either on or in ground, the guiding or rolling support comprising a guiding or rolling rail (10) and a slot (2) filled with a sealing material (4) in which the guiding or rolling rail (10) is positioned, the guiding or rolling rail (10) comprising a head (11) of a shape suitable for the rolling of at least one guiding or rolling wheel (15), a base (12) having a shape similar to a shape of the head (11), and a web (13) joining the head (11) to the base (12), the guiding or rolling rail (10), before being positioned, is partially coated with a filler material (8) to form a coating (18), substantially over its full length, comprising a pair of opposed lateral extensions (16) that contacts the sealing material (4) and forms a lateral groove (9) which facilitates the passage of the guiding or rolling wheel (15); and the guiding or rolling rail (10), coated with the filler material (8), being directly held in place by the sealing material (4), the guiding or rolling rail (10) having a slender cross-section and a combined width of the head (11) and the filler material (8), including the pair of opposed lateral extensions (16), extending normal to the medial longitudinal plane being greater than both a combined width of the base (12) and the filler material (8), extending normal to the medial longitudinal plane, and a combined width of the web (13) and the filler material (8), extending normal to the medial longitudinal plane, while the combined width of the base (12) and the filler material (8) being greated than the combined width of the web (13) and the filler material (8), such that the guiding rail (10) and the filler material (8) together form a Y-shaped configuration, the method comprising the steps of:

making the channel (2);

filling the channel (2) with the sealing material (4);

making a passage (27) in the sealing material (4) of shape substantially complementary to an exterior shape of the guiding or rolling rail (10) with the coating (18);

allowing the sealing material (4) to dry and set; and force fitting the coated guiding or rolling rail (10) until the coated guiding or rolling rail (10) is embedded in the passage (27) such that such force fitting of the coated guiding or rolling rail (10) facilitating bending of the coated guiding or rolling rail (10), about the medial longitudinal plane, during installation.

21. The process according to claim 20, further comprising the step of forming the passage (27) that opens outwardly toward the base.

22. The process according to claim 20, further comprising the step of producing the passage (27) by a sliding shuttering when filling of the channel (2) with the sealing material (4).

23. The process according to claim 20, further comprising the step of producing the passage (27) after the channel (2) has been filled, by forming a groove in the sealing material (4).

* * * * *